US007663574B2

(12) United States Patent
Otsuka et al.

(10) Patent No.: US 7,663,574 B2
(45) Date of Patent: Feb. 16, 2010

(54) DISPLAY DEVICE AND DISPLAY METHOD

(75) Inventors: Akira Otsuka, Zama (JP); Takashi Sasaki, Hiratsuka (JP); Akihiro Takagi, Kawaguti (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 599 days.

(21) Appl. No.: 11/269,711

(22) Filed: Nov. 9, 2005

(65) Prior Publication Data

US 2006/0119546 A1 Jun. 8, 2006

(30) Foreign Application Priority Data

Nov. 9, 2004 (JP) ..... 2004-325441

(51) Int. Cl.
*G09G 3/28* (2006.01)

(52) U.S. Cl. ..... 345/68; 345/60; 345/63

(58) Field of Classification Search ..... 345/60–72, 345/204–214, 690–697; 315/169.4
See application file for complete search history.

(56) References Cited

U.S. PATENT DOCUMENTS 7,133,008 B2 * 11/2006 Naganuma ..... 345/63
2004/0085305 A1 * 5/2004 Kunii et al. ..... 345/204
2004/0201553 A1 * 10/2004 Itokawa et al. ..... 345/60
2005/0212725 A1 * 9/2005 Sasaki et al. ..... 345/63

FOREIGN PATENT DOCUMENTS

| | | |
|---|---|---|
| CN | 1534567 | 10/2004 |
| JP | 2000-148083 | 5/2000 |
| JP | 2003-29700 | 1/2003 |
| KR | 10-20040084853 | 10/2004 |

OTHER PUBLICATIONS

Korean Patent Office Action, mailed Dec. 1, 2006, and issued in corresponding Korean Patent Application No. 10-2005-0106561.
Office Action issued in corresponding Chinese Patent Application No. 200510115844.1 on Oct. 12, 2007.

* cited by examiner

*Primary Examiner*—David L Lewis
(74) *Attorney, Agent, or Firm*—Staas & Halsey LLP

(57) ABSTRACT

A problem is to be solved in that there is to be provided a display device and a display method allowing two or more sorts of sustaining pulses to be employed by switching over the pulses depending on the state of display in such a manner as to achieve characteristics including high light emission efficiency/decrease in streaking and high luminance and the like. The display device is provided wherein one frame image contains a plurality of sub-frames, including: a detection section detecting a state of display: a sustaining pulse output section to select and output one out of two or more sorts of sustaining pulses for a display for each sub-frame depending on the state of display.

17 Claims, 10 Drawing Sheets

F I G. 7

| DISPLAY RATIO | 100~20% | 20~15% | 15~10% | 10~0% |
|---|---|---|---|---|
| SF1 | FIRST PULSE/50 kHz | →SECOND PULSE/40kHz | SECOND PULSE/40kHz→50kHz | SECOND PULSE/50kHz |
| SF2 | FIRST PULSE/50 kHz | | SECOND PULSE/40kHz→50kHz | SECOND PULSE/50kHz |
| SF3 | FIRST PULSE/50 kHz | | SECOND PULSE/40kHz→50kHz | SECOND PULSE/50kHz |
| SF4 | FIRST PULSE/50 kHz | | SECOND PULSE/40kHz→50kHz | SECOND PULSE/50kHz |
| SF5 | FIRST PULSE/50 kHz | | SECOND PULSE/40kHz→50kHz | SECOND PULSE/50kHz |
| SF6 | FIRST PULSE/50 kHz | | SECOND PULSE/40kHz→50kHz | SECOND PULSE/50kHz |
| SF7 | FIRST PULSE/50 kHz | | SECOND PULSE/40kHz→50kHz | SECOND PULSE/50kHz |
| SF8 | FIRST PULSE/50 kHz | | SECOND PULSE/40kHz→50kHz | SECOND PULSE/50kHz |
| SF9 | FIRST PULSE/50 kHz | | SECOND PULSE/40kHz→50kHz | SECOND PULSE/50kHz |
| SF10 | FIRST PULSE/50 kHz | ---------→SECOND PULSE | SECOND PULSE/40kHz→50kHz | SECOND PULSE/50kHz |

DISPLAY DEVICE AND DISPLAY METHOD

CROSS-REFERENCE TO RELATED APPLICATIONS

This application is based upon and claims the benefit of priority from the prior Japanese Patent Application No. 2004-325441, filed on Nov. 9, 2004, the entire contents of which are incorporated herein by reference.

BACKGROUND OF THE INVENTION

1. Field of the Invention

The present invention relates to a display device and a display method.

2. Description of the Related Art

A plasma display (gas discharge display device) is a large scale flat panel display, and is becoming increasingly popular also as wall-mount home television set. For achieving more popularity there are demanded brightness, quality of display and price not falling short of the ones being achievable using the CRT.

For the plasma display, there occurs a problem of streaking as described below. When the number of pixels to be lighted simultaneously is large within a line, voltage drop due to the resistance becomes large, and the emission of light of the pixels to be lighted is made dark. On the other hand, when the number of pixels to be lighted simultaneously within a line is small, the emission of light of the pixels to be lighted is made relatively bright. In this way different lines lead to different brightness even in the event of carrying out the display at the same gradation level or gray value. As the difference in brightness becomes larger, the percentage representation of the streaking is made larger, which is not preferable.

In connection with the AC type color plasma display, a further increase in the light emission efficiency and decrease in streaking are required, and driving methods of sustaining discharge are being developed. The sustaining pulse such as in the 2-step discharge (See, for example, Patent document 1, below.) and the pop discharge (See, for example, Patent document 2, below.) is such that the discharge peak intensity decreases; the light emission efficiency increases; and the streaking decreases caused by the difference in voltage drop between electrodes, but there is a problem of decrease in the peak luminance.

For example, in the 2-step discharge the sustaining pulses rise in two steps, wherein in the first step voltage of the sustaining pulse a weak discharge is generated and in the second step of the sustaining pulse a sustaining discharge is generated successively. By using the 2-step discharge waveform, since a discharge current peak is small, a voltage drop in the wiring line is small, consequently resulting in a reduction in streaking. It is also distinctive feature that small discharge intensity and reduction in ultraviolet light emission and saturation in the fluorescent material or the like lead to the light emission efficiency higher by 10% or more. Nevertheless, due to the small peak discharge current, emission intensity by a single shot is lower, and the pulse width becomes broader due to the 2-step waveform, with the result that it is impossible to increase the number of the sustaining pulses, and peak luminance decreases by 20%.

In order to realize both of high emission efficiency/decrease in streaking and high luminance, it might be conceivable to change the sorts of the sustaining pulse depending upon a state of display, but a switching shock would pose a problem since luminance and chromaticity would vary depending on sorts of the pulses. To overcome the problem of this switching shock, it might also be conceivable to allow the sustaining pulses in a sub-frame to be comprised of two sorts of sustaining pulse and to change gradually the proportion of these two sorts of the sustaining pulse. But since the state of discharge/wall charge varies depending on the sort of the sustaining pulse, the display operation becomes unstable, and further control thereof is also made difficult.

[Patent document 1] Japanese Patent Application Laid-open No. 2000-148083

[Patent document 2] Japanese Patent Application Laid-open No. 2003-29700

SUMMARY OF THE INVENTION

The object of the present invention is to provide a display device and a display method allowing 2 or more sorts of sustaining pulses to be employed by switching over the pulses depending on the state of display in such a manner as to achieve characteristics such as high light emission efficiency/reduction in streaking and high luminance or the like.

According to an aspect of the present invention, there is provided a display device in which a frame is constituted by a plurality of sub-frames, the display device comprising; a detection section to detect the state of display and a sustaining pulse output section to select and output one out of 2 or more sorts of sustaining pulses for a display for each sub-frame depending on the state of display.

BRIEF DESCRIPTION OF THE DRAWINGS

FIG. 7 shows the relationship between the display ratio and the sustaining pulse in each of sub-frames.

DETAILED DESCRIPTION OF THE PREFERRED EMBODIMENTS

First Embodiment

Figure 1:
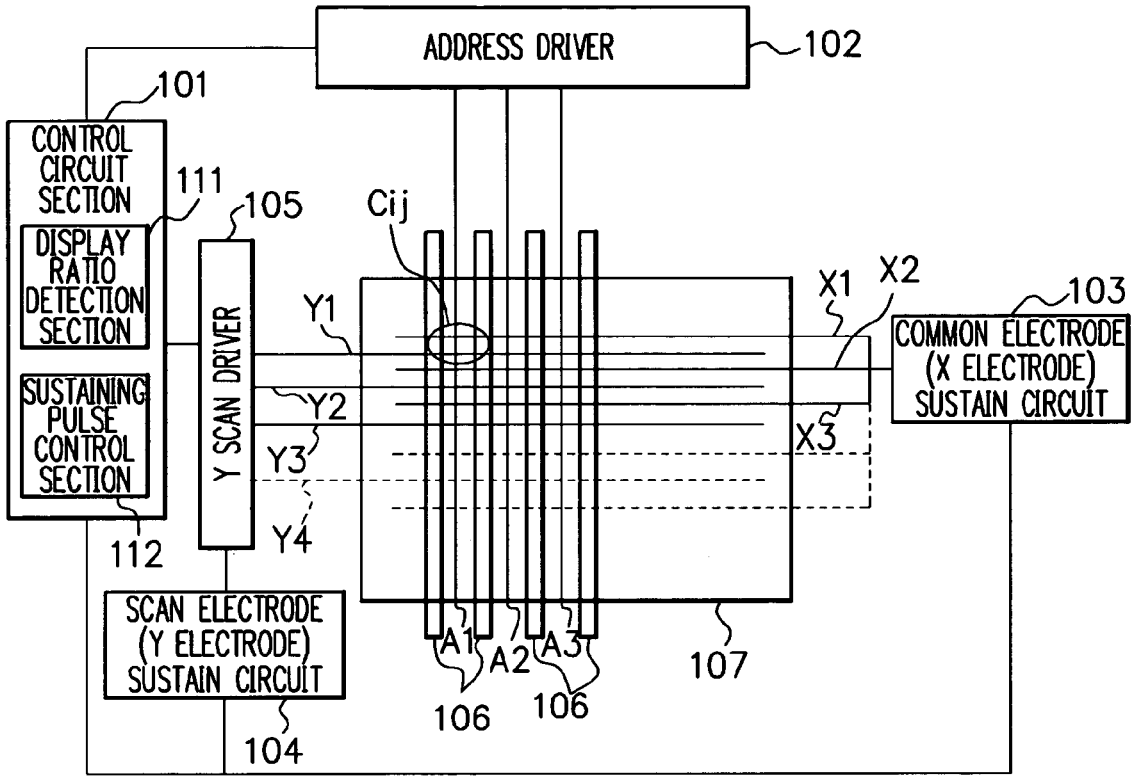
FIG. 1 is an example of the basic configuration of the plasma display (display device) according to the first embodiment of the present invention.

FIG. 1 shows an example of the basic configuration of the plasma display (display device) according to the first embodiment of the present invention. A control circuit section 101 has a display ratio detection section 111 and a sustaining pulse control section 112 and controls an address driver 102, a common electrode (x Electrode) sustain circuit 103, a scan electrode (Y electrode) sustain circuit 104 and a scan driver 105.

The address driver 102 supplies a predetermined voltage to address electrodes A1, A2, A3, . . . . Hereafter, each of the address electrodes A1, A2, A3, . . . or the generic name of them is referred to as an address electrode Aj, where j is a subscript or suffix.

The scan driver 105 supplies a predetermined voltage to Y electrodes Y1, Y2, Y3, . . . , based upon the control of the control circuit section 101 and the Y electrode sustain circuit 104. Hereafter, each of the address electrodes Y1, Y2, Y3, . . . or the generic name of them is referred to as a Y electrode Yi, where i is a subscript.

The X electrode sustain circuit 103 supplies the same voltage to each of X electrodes X1, X2, X3, . . . . Hereafter, each of the X electrodes X1, X2, X3, . . . or the generic name of them is referred to as an X electrode Xi, where i is a subscript. Each of the X electrodes Xi is mutually connected and has the same voltage level.

In the display area 107, the Y electrode Yi and the X electrode Xi extend parallel to the horizontal direction to form a row, and the address electrode Aj form a column extending to the vertical direction. The Y electrode Yi and the X electrode Xi are arranged alternately in the vertical direction. A rib 106 has a stripe rib structure disposed between each of the address electrodes Aj.

The Y electrode Yi and the address electrode Aj form a two dimensional matrix having i row and j column. A display cell Cij is formed by the intersection of the Y electrode Yi and the address electrode Aj and the X electrode Xi adjacent thereto correspondingly. This display cell Cij corresponds to a pixel, and the display area 107 can display a two dimensional image. The X electrode Xi and the Y electrode Yi in the display cell Cij have a space between them and constitute a capacitive load.

The display ratio detection section 111 detects a display ratio of an image in one frame based on the image data which is inputted externally to display on the display area 107. The display ratio is detected based on the number of the emitting pixels and the gradation level of the emitting pixel. For example, if all of the pixels in the image of a given frame is displaying with the maximum value of gradation, then the display ratio is 100%. And, if all of the pixels in the image of a given frame is displaying with the half maximum value of gradation, then the display ratio is 50%. Furthermore, if half of the total pixels in the image of a given frame is displaying with the maximum value of gradation, then the display ratio is also 50%.

Alternatively, the display ratio detection section 111 may detect a display ratio based on the sustaining current flowing or the consumed sustaining power by the sustaining pulse of the X electrode sustain circuit 103 and/or the Y electrode sustain circuit 104. In the emitting pixel, discharge occurs in the corresponding display cell Cij to emit light. Therefore, also by measuring the sustaining current that is a discharge current flowing then, or the sustaining power, the display ratio can be detected.

Large display ratio corresponds to a bright image as a whole, and small display ratio corresponds to a dark image as a whole. In a dark image, high luminance is required when a bright color such as a flash of a head light or the like is to be displayed.

Furthermore, in the case of large display ratio, since the emission efficiency and the streaking pose a problem, it is preferable to use a sustaining pulse which allows the emission efficiency to be increased and reduce the streaking. On the other hand, in the case of small display ratio, since the emission efficiency does not pose a problem so much and the streaking does not pose a problem so much because of small voltage drop of the display load for each line, it is preferable to use a sustaining pulse which allows the peak luminance to be increased.

The sustaining pulse control section 112 controls the X electrode sustain circuit 103 and the Y electrode sustain circuit 104 based upon the display ratio detected by the display ratio detecting section 111. More concretely, in the case when the display ratio is large, it generates a sustaining pulse which can increase the emission efficiency and reduce the streaking, and in the case when the display ratio is small, it generates a sustaining pulse which can increase the peak luminance. The detail thereof is explained later by referring to FIG. 4A and FIG. 4B.

Figure 2A:
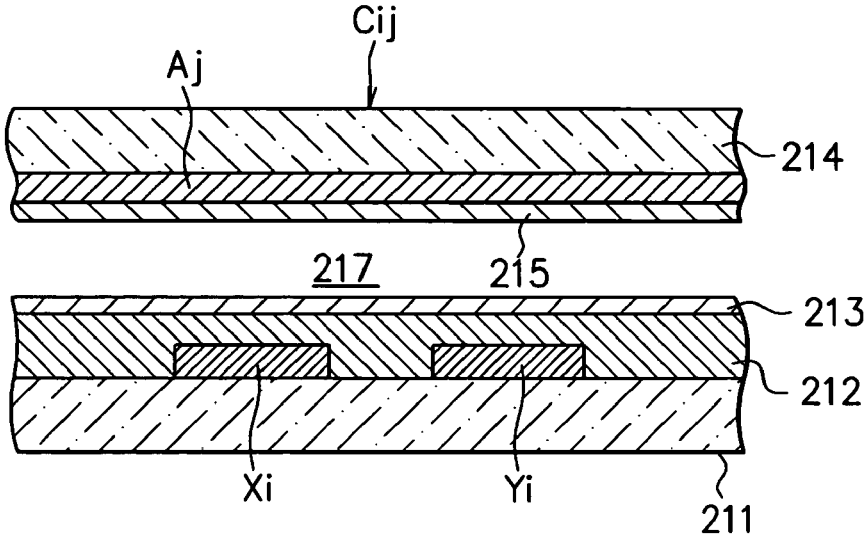
FIGS. 2A to 2C are cross-sectional views of the configuration example of the display cell.

FIG. 2A is a cross-sectional view of the configuration example of the display cell Cij shown in FIG. 1. The X electrode Xi and the Y electrode Yi are formed on a front glass substrate 211. Thereupon a dielectric layer 212 is deposited to isolate them from the discharge space 217. A protection film of MgO (magnesium oxide) 213 is coated furthermore thereon.

On the other hand, the address electrode Aj is formed on a rear glass substrate 214 disposed on the opposite side of the front glass substrate 211, wherein a dielectric layer 215 is deposited thereon, and a fluorescent material is coated furthermore thereon. The discharge space 217 between the MgO protection film 213 and the dielectric layer 215 is filled with Ne+Xe Penning gas or the like.

Figure 2B:
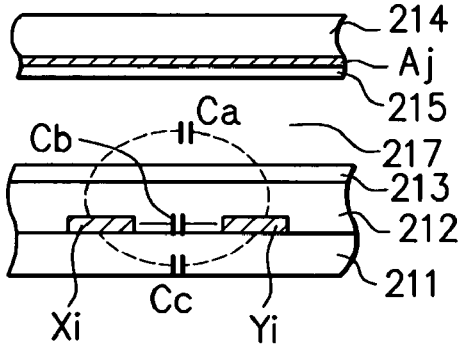

FIG. 2B is an illustration for explaining a panel capacitance Cp of the AC drive type plasma display. A capacitance Ca is a capacitance of the discharge space 217 between the X electrode Xi and the Y electrode Yi. A capacitance Cb is a capacitance of the dielectric layer 212 between the X electrode Xi and the Y electrode Yi. A capacitance Cc is a capacitance of the front glass substrate 211 between the X electrode Xi and the scan electrode Yi. Depending on the summation of these capacitances Ca, Cb, and Cc, the panel capacitance Cp between the X electrode Xi and the Y electrode Yi is determined.

Figure 2C:
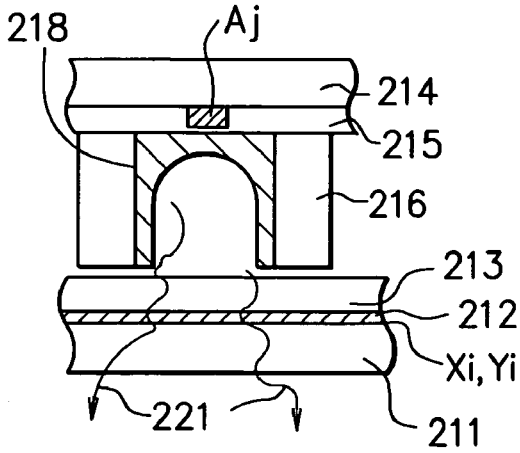

FIG. 2C is an illustration for explaining the light emission of the AC drive type plasma display. On the inner surface of the rib 216, the fluorescent materials 218 for red, blue and green colors are disposed and deposited in a stripe pattern separately by colors. Discharge between the X electrode Xi and the Y electrode Yi excites the fluorescent materials 218, thereby emitting the light 221.

Figure 3:
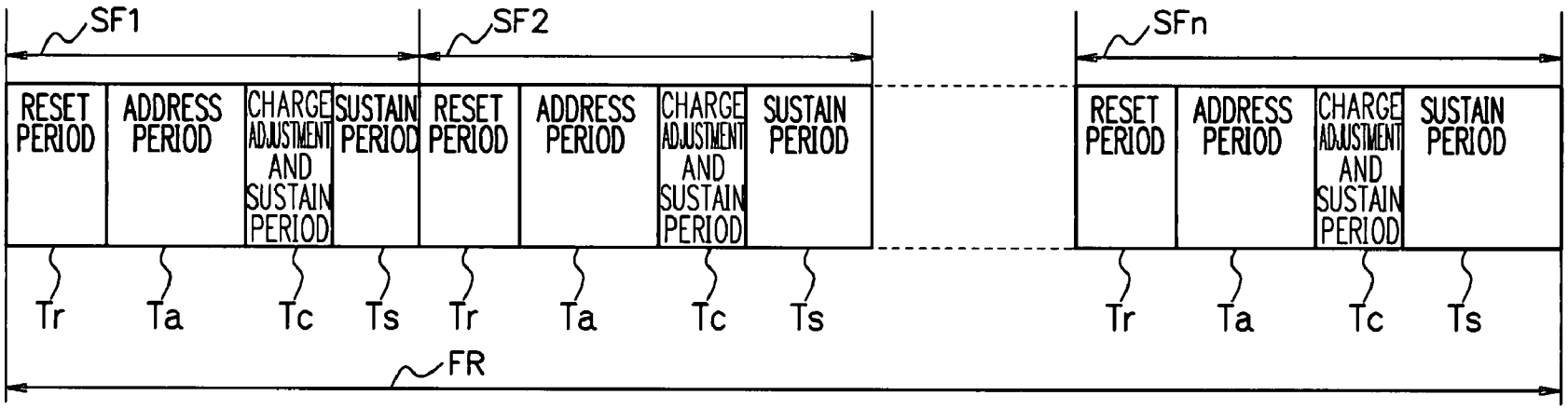
FIG. 3 shows an example of constitution of a frame.

FIG. 3 shows an example of constitution of a frame FR of an image. The image is formed at a rate of 60 frames/second, for example. A frame FR is comprised of the first sub-frame SF1, the second sub-frame SF2, . . . , and the n-th sub-frame SFn. This n is equal to 10, for example, and corresponds to the gradation bit number. Each of the sub-frames SF1, SF2 and the like or the generic name of them is referred to hereafter as sub-frame SF.

Each of the sub-frames SF is comprised of a reset period Tr, an address period Ta, a charge adjustment and sustain period Tc and a sustain (sustaining discharge) period Ts. During the reset period Tr, display cells are initialized. During the address period Ta, by an address discharge between the address electrode Aj and the Y electrode Yi, selection can be made between emission and not-emission of each display cell. During the charge adjustment and sustain period Tc, a charge adjustment is made for the sustain discharge during the following sustain period Ts, and, for example, pulse width is broad. During the sustain period Ts a sustain discharge is made between the X electrode Xi and the Y electrode Yi of the selected display cell, thereby light is emitted. Number of occurrence of light emission (length of the sustain period Ts) by the sustaining pulse between the X electrode Xi and the Y electrode Yi is different for each sub-frame. Thus, the gradation value is determined.

In the present embodiment, a different sort of the sustaining pulse during the sustain period Ts is applied depending on the display ratio. During the charge adjustment and sustain period Tc a charge adjustment is made suitably to the respective sort of the sustaining pulse.

Figure 4A:
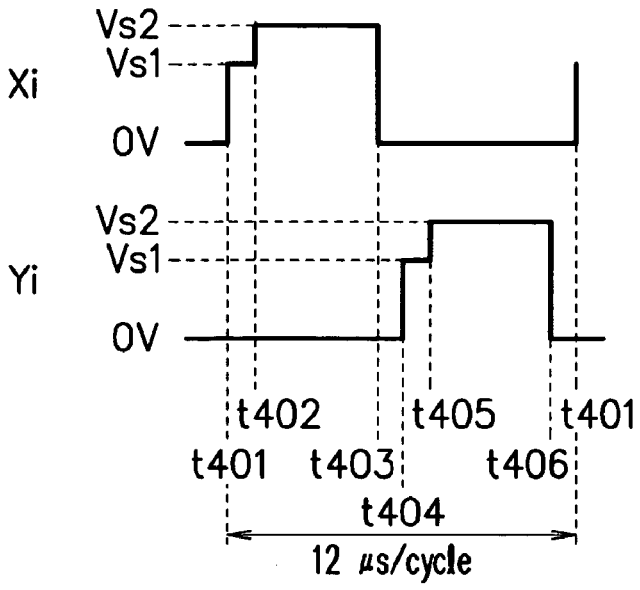
FIG. 4A is a timing chart indicating sustaining pulses on the X electrode and the Y electrode in the case of a large display ratio.
Figure 4B:
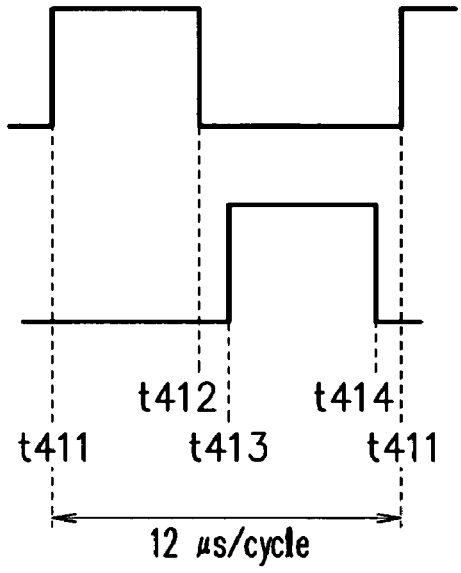
FIG. 4B is a timing chart indicating sustaining pulses on the X electrode and the Y electrode in the case of a small display ratio.

FIG. 4A is a timing chart indicating sustaining pulses on the X electrode Xi and the Y electrode Yi in the case of a large display ratio. FIG. 4B is a timing chart indicating sustaining pulses on the X electrode Xi and the Y electrode Yi in the case of a small display ratio. Under control by the sustaining pulse control section 112, the Y electrode sustain circuit 104 in FIG. 1 generates the sustaining pulse shown in FIG. 4A in the case of a large display ratio, and the sustaining pulse shown in FIG. 4B in the case of a small display ratio. The sustaining pulse shown in FIG. 4A and FIG. 4B is generated during the sustain period Ts shown in FIG. 3.

The sustaining pulses of the X electrode Xi and the Y electrode Yi shown FIG. 4A are repeated with a period including duration from time t401 to t406 being a cycle.

First, an explanation is given to the sustaining pulse of the X electrode Xi shown in FIG. 4A. At time t401 it starts to rise from the low level, i.e. 0V level and is clamped at the first high level Vs1 which is higher than the low level. Next, at time t402, it rises from the first high level and is clamped at the higher, second high level Vs2. Next, at time t403, it falls down from the second high level Vs2 and is clamped at the 0V low level. Hereafter it retains the 0V low level up to the end of the cycle.

Next, an explanation is given to the sustaining pulse of the Y electrode Yi shown in FIG. 4A. From time t401 to immediately prior to time t404 it maintains at the 0V low level. At time t404 it starts to rise from the 0V low level and is clamped at the first high level Vs1 which is higher than the low level. Next, at time t405, it rises from the first high level and is clamped at the higher, second high level Vs2. Next, at time t406, it falls down from the second high level and clamped at the 0V low level. Hereafter it sustains the 0V low level up to the end of the cycle.

This sustaining pulse is 12 μs/cycle. For example, from time t401 to t402 it is 1 μs, from time t402 to t403 is 4 μs, from time t403 to t404 is 1 μs, from time t404 to t405 is 1 μs, from time t405 to t406 is 4 μs, and from time t406 to t401 in the next cycle is 1 μs.

At time t401 and t404 an electric potential difference Vs1 is generated between the X electrode Xi and the Y electrode Yi and weak discharge happens. At time t402 and t405 an electric potential difference Vs2 is generated between the X electrode Xi and the Y electrode Yi and discharge is sustained to occur. Since this sustaining pulse is the sustaining pulse which distributes the electric power in time, time width of the discharge current becomes broad, and the peak discharge current becomes small. As a result, discharge intensity becomes small, ultraviolet emission intensity and saturation of the fluorescent material becomes small, and then emission efficiency increases. Furthermore, because of the small peak discharge current the streaking can be reduced.

The sustaining pulses of the X electrode Xi and the Y electrode Yi shown in FIG. 4B are repeated by taking a period including duration from time t411 to t414 as a cycle.

First, an explanation is given to the sustaining pulse of the X electrode Xi shown in FIG. 4B. At time t411 it starts to rise from the low level, i.e., 0V level and is clamped at the second high level Vs2 which is higher than the low level. Next, at time t412, it falls down from the second high level Vs2 and is clamped at the 0V low level. Hereafter it sustains the 0V low level up to the end of the cycle.

First, an explanation is given to the sustaining pulse of the Y electrode Yi shown in FIG. 4B. From time t411 to immediately prior to time t413 it maintains at the 0V low level. At time t413 it starts to rise from the 0V low level and is clamped at the second high level Vs2 which is higher than the low level. Next, at time t414, it falls down from the second high level Vs2 and clamped at the 0V low level. Hereafter it sustains the 0V low level up to the end of the cycle.

This sustaining pulse is 12 μs/cycle. For example, from time t411 to t412 it is 5 μs, from time t412 to t413 is 1 μs, from time t413 to t414 is 5 μs, from time t414 to t411 in the next cycle is 1 μs.

At time t411 and t413 an electric potential difference Vs2 is generated between the X electrode Xi and the Y electrode Yi and strong discharge happens. Since this sustaining pulse is the sustaining pulse which concentrates the electric power in time, time width of the discharge current becomes narrow, and the peak discharge current becomes large. As a result, the peak luminance becomes high.

Figure 5:
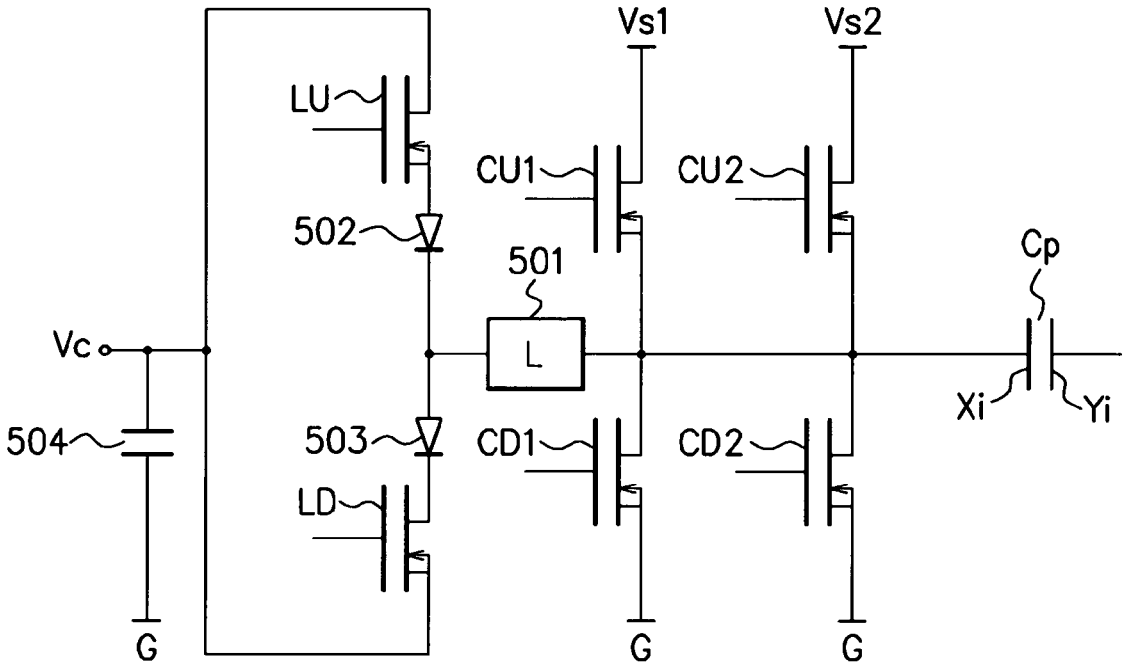
FIG. 5 shows a circuit diagram associated with an exemplary construction of the X electrode sustain circuit connecting to the X electrode.

FIG. 5 shows a circuit diagram illustrating an exemplary constitution of the X electrode sustain circuit 103 connecting to the X electrode Xi (shown in FIG. 1). The Y electrode sustaining circuit 104 connecting to the Y electrode Yi has similar construction to the X electrode sustain circuit 103, then an explanation is given to the X electrode sustain circuit 103 as an example. Hereafter, MOS field effect transistor (FET) is referred to simply as a transistor.

The X electrode Xi and the Yi electrode have an insulator interposed therebetween, and constitute a panel capacitance Cp. A source and a drain of an n-channel transistor CU1 are connected to the X electrode Xi and the first high level Vs1, respectively. A source and a drain of an n-channel transistor CU2 are connected to the X electrode Xi and the second high level Vs2, respectively. Sources and drains of n-channel transistor CD1 and CD2 are connected to the ground (0V level) and the X electrode Xi, respectively.

A capacitor 504 is connected between the potential Vc and the ground G. A source and a drain of an n-channel transistor LU are connected to the anode of a diode 502 and the capacitor 504, respectively. The cathode of the diode 502 is connected to the X electrode Xi through a coil 501. A source and a drain of an n-channel transistor LD are connected to the capacitor 504 and the cathode of the diode 502, respectively. The anode of the diode 503 is connected to the X electrode Xi through a coil 501.

Figure 6A:
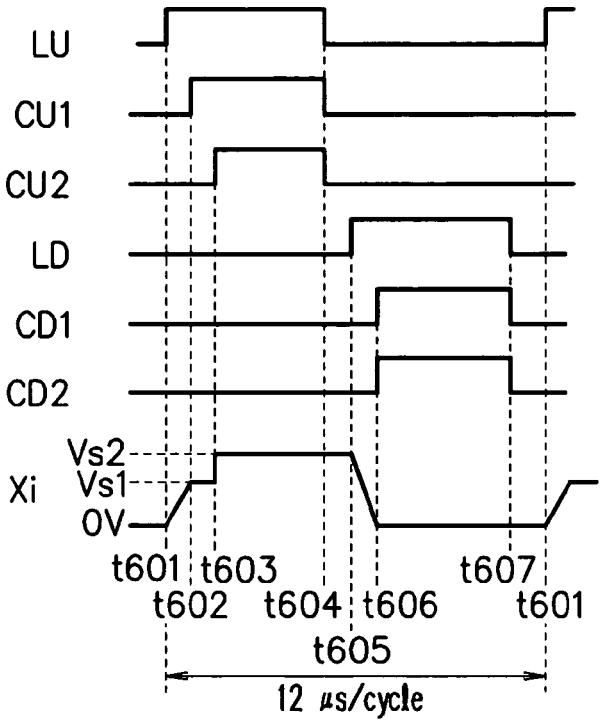
FIG. 6A shows a sustaining pulse generated by the X electrode sustain circuit shown in FIG. 5 in the case of a large display ratio.

FIG. 6A shows a sustaining pulse generated by the X electrode sustain circuit shown in FIG. 5 in the case of a large display ratio. This corresponds to the sustaining pulse shown in FIG. 4A.

Prior to time t601 the transistors LU, CU1, CU2 and LD are off, and the transistors CD1 and CD2 are on. At time t601 the transistors CD1 and CD2 are turned off and the transistor LU is turned on. As explained later, the capacitor 504 stores the electric power recovered from the X electrode Xi of the panel capacitance Cp. When the transistor LU turns on, electric charges in the capacitor 504 are supplied to the X electrode Xi through the transistor LU and the coil 501 by LC resonance. When the electric potential Vc is set to about Vs1/2, the electric potential of the X electrode Xi rises toward the first high level Vs1.

Next, at time t602 the transistor CU1 is turned on. Then, the first high level Vs1 is supplied to the X electrode Xi, and the electric potential of the X electrode Xi is clamped at the first high level Vs1.

Next, at time t603 the transistor CU2 is turned on. Then, the second high level Vs2 is supplied to the X electrode Xi, and the electric potential of the X electrode Xi is clamped at the second high level Vs2.

Next, at time t604 the transistors LU, CU1 and CU2 are turned off. The electric potential of the X electrode Xi is sustained at the second high level Vs2.

Next, at time t605 the transistor LD is turned on. Electric charges (electric power) on the X electrode Xi of the panel capacitance Cp is recovered to the capacitor 504 through the coil 501 and the transistor LD by LC resonance, and the electric potential of the X electrode Xi drops. By recovering the electric power in such a way the power consumption can be reduced.

Next, at time t606 the transistors CD1 and CD2 are turned on. Then the ground level is connected to the X electrode Xi, and the X electrode Xi is clamped at 0V.

Next, at time t607 the transistors LD, CD1 and CD2 are turned off. The electric potential of the X electrode Xi is sustained at 0V.

The same process is repeated by taking a period including duration from time t601 to t607 as a cycle. This sustaining pulse is 12 μs/cycle. For example, from time t601 to t602 it is 0.5 μs, from time t602 to t603 is 0.5 μs, from time t603 to t604 is 3 μs, from time t604 to t605 is 1 μs, from time t605 to t606 is 0.5 μs, and from time t606 to t607 is 5.5 μs, and from time t607 to t601 in the next cycle is 1 μs.

Figure 6B:
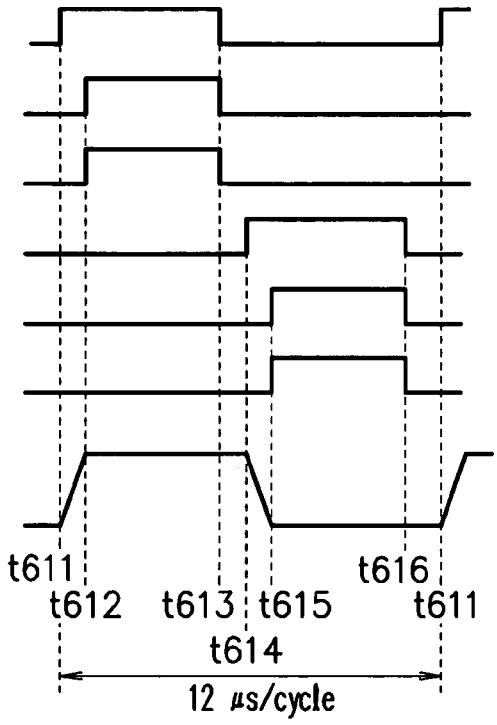
FIG. 6B shows a sustaining pulse generated by the X electrode sustain circuit shown in FIG. 5 in the case of a small display ratio.

FIG. 6B shows a sustaining pulse generated by the X electrode sustain circuit shown in FIG. 5 in the case of a small display ratio, and this corresponds to the sustaining pulse shown in FIG. 4B.

Prior to time t611 the transistors LU, CU1, CU2 and LD are off, and the transistors CD1 and CD2 are on. At time t611 the transistors CD1 and CD2 are turned off and the transistor LU is turned on. As explained later, the capacitor 504 stores the electric power recovered from the X electrode Xi of the panel capacitance Cp. When the transistor LU turns on, electric charges in the capacitor 504 are supplied to the X electrode Xi through the transistor LU and the coil 501 by LC resonance. When the electric potential Vc is set to Vs2/2, the electric potential of the X electrode Xi rises toward the second high level Vs2.

Next, at time t612 the transistors CU1 and CU2 are turned on. Then, the second high level Vs2 is supplied to the X electrode Xi, and the electric potential of the X electrode Xi is clamped at the second high level Vs2.

Next, at time t613 the transistors LU, CU1 and CU2 are turned off. The electric potential of the X electrode Xi is sustained at the second high level Vs2.

Next, at time t614 the transistor LD is turned on. Electric charges (electric power) on the X electrode Xi of the panel capacitance Cp is recovered to the capacitor 504 through the coil 501 and the transistor LD by LC resonance, and the electric potential of the X electrode Xi drops. By recovering the electric power in such a way the power consumption can be reduced.

Next, at time t615 the transistors CD1 and CD2 are turned on. Then the ground level is connected to the X electrode Xi, and the X electrode Xi is clamped at 0V.

Next, at time t616 the transistors LD, CD1 and CD2 are turned off. The electric potential of the X electrode Xi is retained at 0V.

The same process is repeated by taking a period including duration from time t611 to t616 as a cycle. This sustaining pulse is 12 μs/cycle. For example, from time t611 to t612 it is 0.5 μs, from time t612 to t613 is 3.5 μs, from time t613 to t614 is 1 μs, from time t614 to t615 is 0.5 μs, from time t615 to t616 is 5.5 μs, and from time t616 to t611 in the next cycle is 1 μs. By the way, the transistors CD1 and CD2 may be comprised of a single transistor.

FIG. 7 shows the relationship between the display ratio and the sustaining pulse in each of the sub-frame SF. As shown in FIG. 3 a frame FR is comprised of, for example, 10 sub-frames SF1 to SF10. Among the sub-frames SF1 to SF10, the sub-frame SF1 has the smallest number of the sustaining pulse and the luminance is the lowest, whereas the sub-frame SF10 has the largest number of the sustaining pulse and the luminance is the highest. The number of the sustaining pulse in a sub-frame increases gradually from the sub-frame SF1 to the sub-frame SF10.

Hereafter, the sustaining pulse which distributes the electric power in time as shown in FIG. 4A and FIG. 6A is called the first sustaining pulse, and the sustaining pulse which concentrates the electric power in time as shown in FIG. 4B and FIG. 6B is called the second sustaining pulse.

When the display ratio is 20 to 100%, the first sustaining pulse with, for example, 50 kHz is generated in all of the sub-frames SF1 to SF10.

When the display ratio is 15%, the second sustaining pulse with, for example, 40 kHz is generated in all of the sub-frames SF1 to SF10. The second sustaining pulse with 40 kHz gives the luminance nearly equal to that given by the first sustaining pulse with 50 kHz. Here, the frequency of 40 kHz and 50 kHz stands for the number of the sustaining pulse numerically, and the period may be the same. This means that the luminance is the same as long as the display ratio is in a range of 15 to 100%. By this means, drastic change in the luminance can be prevented when the first sustaining pulse is changed over to the second sustaining pulse.

That is, when in a frame there are mixed sub-frames being composed of the first sustaining pulse and sub-frames being composed of the second sustaining pulse, the luminance in the sub-frames being composed of the first sustaining pulse and the sub-frames being composed of the second sustaining pulse is almost the same, but, in terms of their pulse number there is a difference between them.

But if all of the sub-frames changes from the first sustaining pulse with 50 kHz to the second sustaining pulse with 40 kHz due to a small change in the display ratio, chromaticity changes suddenly, which gives disadvantageous effect on the display. Therefore in the case when the display ratio is in a range of 15 to 20%, sub-frames being composed of the first sustaining pulse and sub-frames being composed of the second sustaining pulse are preferably mixed in a frame with gradual change in the ratio of number of sub-frames with the first sustaining pulse to that of sub-frames with the second sustaining pulse.

In the case where the display ratio is less than 20% as well as more than 15%, sub-frames SF being composed of the first sustaining pulse and sub-frames SF being composed of the second sustaining pulse are mixed. In the case where the display ratio is slightly less than 20%, one sub-frame SF1 comprises the second sustaining pulse with 40 kHz and nine sub-frames SF2 to SF10 comprise the first sustaining pulse with 50 kHz. In the case where the display ratio is slightly larger than 15%, nine sub-frames SF1 to SF9 comprise the second sustaining pulse with 40 kHz and one sub-frame SF10 consists of the first sustaining pulse with 50 kHz. In the case where the display ratio is between 15% and 20%, smaller display ratio increases the ratio of number of sub-frames being composed of the second sustaining pulse with 40 kHz. This method prevents the occurrence of the drastic change in the chromaticity due to a slight difference in the display ratio.

In the case where the display ratio is between 10% and 15%, smaller display ratio increases gradually the number of pulse in the second sustaining pulse. In the case where the display ratio is 15%, all of the sub-frames SF1 to SF10 generate the second sustaining pulse with 40 kHz, for example, and then luminance is relatively low. In the case where the display ratio is 10%, all of the sub-frames SF1 to SF10 generate the second sustaining pulse with 50 kHz, for example, and then luminance can be made relatively high and peak luminance can be increased.

In the case where the display ratio is between 0% and 10%, all of the sub-frames generate the second sustaining pulse with 50 kHz, irrespective of the display ratio.

According to the present embodiment, there is provided a sustaining pulse output section, which, depending on the display ratio, selects and outputs one from more than two sorts of sustaining pulse for a display for each sub-frame. The sustain output section is comprised of the sustaining pulse control section 112, the X electrode sustain circuit 103 and the Y electrode sustain circuit 104. It selects the first sustaining pulse or the second sustaining pulse depending on the display ratio. When the display ratio is larger than a threshold value it selects the first sustaining pulse, and when the display ratio is smaller than the threshold value it selects the second sustaining pulse.

More concretely, when the display ratio is more than the first threshold of 20%, all of the sub-frames in the frame comprise the first sustaining pulse, and in the case where the display ratio is less than the first threshold of 20%, sub-frames being composed of the second sustaining pulse are included in the frame. In the case where the display ratio is less than the second threshold of 15%, all of the sub-frames in the frame comprise the second sustaining pulse but the number of the pulses is changed based upon the display ratio. In the case where the display ratio is less than the second threshold of 15% but is larger than the third threshold of 10%, the number of the sustaining pulses in the sub-frame increases when the display ratio becomes small. In the case when the display ratio is less than the third threshold of 10%, all of the sub-frames in the frame comprise the second sustaining pulse and the number of the sustaining pulses is constant. The second threshold is smaller than the first threshold and the third threshold is smaller than the second threshold.

In the case where the display ratio is less than the first threshold of 20% but larger than the second threshold of 15%, the frame is comprised of the sub-frames being composed of the first sustaining pulse and the sub-frames being composed of the second sustaining pulse. According to the display ratio, the ratio changes which is the number of the sub-frames being composed of the first sustaining pulse versus the number of the sub-frames being composed of the second sustaining pulse included in a frame. In this case a percentage of the number of the sub-frames being composed of the second sustaining pulse becomes large when the display ratio becomes small.

The first sustaining pulse enabling the improvement in the emission efficiency and the streaking is accompanied by lower peak luminance as compared with the second sustaining pulse. Power consumption of the plasma display increases as the display ratio becomes large. Furthermore, the streaking appears such that for each of a line associated with a large display ratio and a line associated with a small display ratio respectively a different discharge current flows, resulting in the visible difference in luminance caused by the voltage drop, and does not pose a problem when the display ratio is small. In usual image display the streaking is scarcely seen when the display ratio is less than about 25%, and it does not cause an issue when the display ratio is less than 15%. Therefore, the first threshold in the display ratio of 20% in the above explanation is preferably revised to less than 25%.

Furthermore, in the case when the display ratio is less than 20%, power consumption due to the sustain discharge is small so that the first sustaining pulse which improves the emission efficiency is not always necessary. Furthermore, peak luminance becomes apparent in a high luminance pixel in a relatively dark image such as reflection of a glass or a flash of a head light, and is required in the case where the display ratio is less than 10% or especially less than 5%. Therefore, the third threshold in the display ratio of 10% in the above explanation is preferably revised to more than 5%.

As explained above, a frame FR is comprised of, for example, 10 sub-frames SF1 to SF10. Each of the sub-frame SF comprising a reset period Tr, an address period Ta, a charge adjustment and sustain period Tc and a sustain period Ts. In the sustain period Ts the first sustaining pulse is formed from a repetition of the 2-step waveform shown in FIG. 6A and the second sustaining pulse is formed from a repetition of the conventional discharge waveform shown in FIG. 6B. Relative weight of luminance in each of the sub-frame is such that the first sub-frame SF1 gives the lowest luminance and the 10th sub-frame SF10 gives the highest one. The rising and falling edges of the first and the second sustaining pulses utilize the power recovery circuit (power save circuit) by the LC resonance. In spite of the same gradation being employed the number of the sustaining pulses is changed between the sub-frame with the first sustaining pulse and the sub-frame with the second sustaining pulse. The first sustaining pulse is large in number of sustaining pulses, i.e. high in frequency, in order to keep constant the luminance in each sub-frame SF. The display ratio is calculated or estimated from the image data or power consumption (current consumption), and when the display ratio is more than 20% display is made by all sub-frame with the first sustaining pulse, and when the display ratio is between 20% and 15%, change is made in order from the sub-frame with the first sustaining pulse to the sub-frame with the second sustaining pulse, and when the display ratio is less than 15%, all sub-frames are with the second sustaining pulse. The maximum number of the sustaining pulses increases in inverse proportion to the display ratio when the display ratio changes between 15% and 10%, and when the display ratio is less than 10% it keeps constant at a value larger than the value when the display ratio is more than 15%. In the present embodiment, the number of pulse (frequency) for maximum luminance of the first sustaining pulse is 50 kHz, the number of pulse (frequency) for maximum luminance of the second sustaining pulse is 40 kHz during the change of sub-frame, and the number of pulse (frequency) for maximum luminance of the second sustaining pulse is 50 kHz when the display ratio is less than 10%.

According to the present embodiment, in a displaying state where emission efficiency/streaking poses a problem the first sustaining pulse is used for display, and then high emission efficiency and reduced streaking can be obtained. Although the first sustaining pulse still gives the maximum luminance of about 800 cd/m$^2$ even in the case of the low display ratio, in a displaying state where emission efficiency/streaking scarcely poses a problem, the second sustaining pulse is used. Since the second sustaining pulse can be made more than 50 kHz in pulse number (frequency), higher luminance (peak) can be realized. In the case of low display ratio, the maximum luminance is about 1000 cd/m$^2$ and display can be made with high peak luminance. Since a change is made from the first sustaining pulse to the second sustaining pulse within a sub-frame with the same luminance of about 800 cd/m$^2$, switching shock of luminance does not happen. Since the change is made gradually in unit of sub-frame, switching shock of chromaticity is almost negligible. Furthermore since the sub-frame is changed in order from a small gradation value, low luminance sub-frame, influence of the change in sort of the sustaining pulse to the emission efficiency/streaking becomes smaller. That is, a frame contains a plurality of sub-frames with different luminance, and when the sub-frames being composed of the first sustaining pulse are mixed in a frame with the sub-frames being composed of the second sustaining pulse, a sub-frame with low luminance is changed with priority to a sub-frame being composed of the second sustaining pulse. When changing the sustain frequency or sub-frame depending on the display ratio, in order to prevent frequent change from occurring, it is usual that hysteresis characteristics is provided.

In the present embodiment, arrangement is made in order from the sub-frame with low luminance to the sub-frame with high luminance. Sometimes the order of the gradation is changed to improve the quality of image. Even in this case the sort of the sustaining pulse is preferably changed from the sub-frame with low luminance to reduce an influence on the streaking and the emission efficiency.

Second Embodiment

Figure 8:
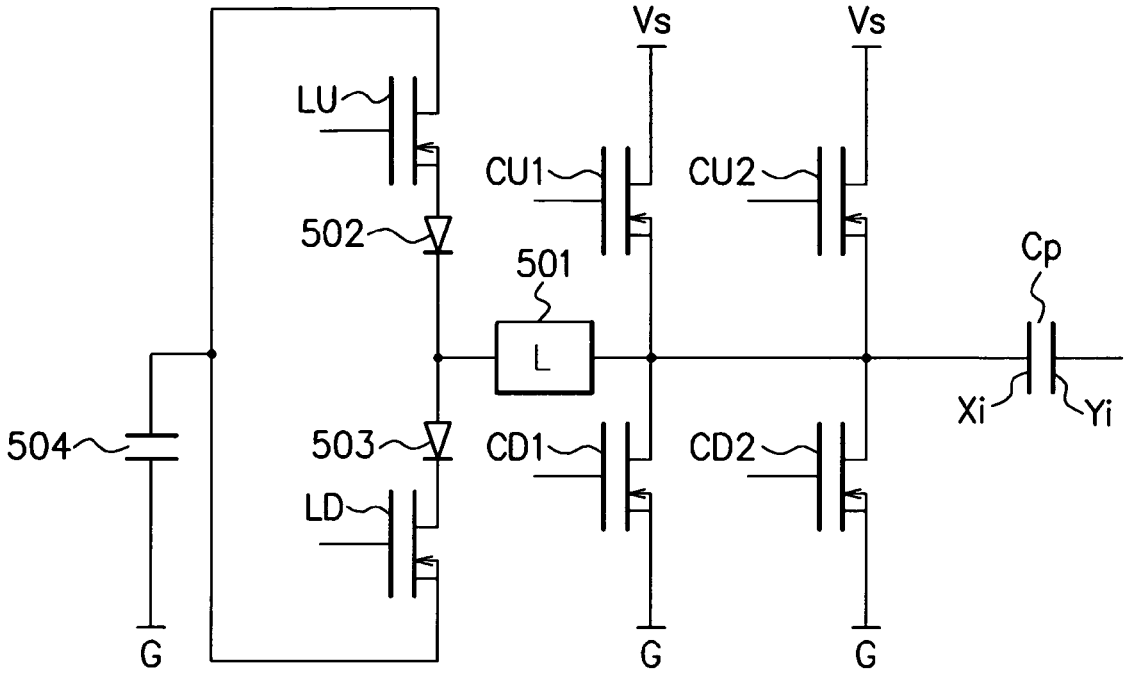
FIG. 8 shows a circuit diagram pertaining to an exemplary constitution of the X electrode sustain circuit according to the second embodiment of the present invention.

FIG. 8 shows a circuit diagram showing a construction example of the X electrode sustain circuit 103 (FIG. 1) according to the second embodiment of the present invention. The circuit shown in FIG. 8 is a circuit in place of the circuit shown in FIG. 5, and the differences from the circuit shown in FIG. 5 will be explained below. The drain of the transistor CU1 is connected to the high level Vs instead of the first high level Vs1. The drain of the transistor CU2 is connected to the high level Vs instead of the second high level Vs2. The capacitor 504 is not necessary to connect to a potential Vs/2, because the potential thereof becomes about Vs/2 due to the electric power recovery.

Figure 9A:
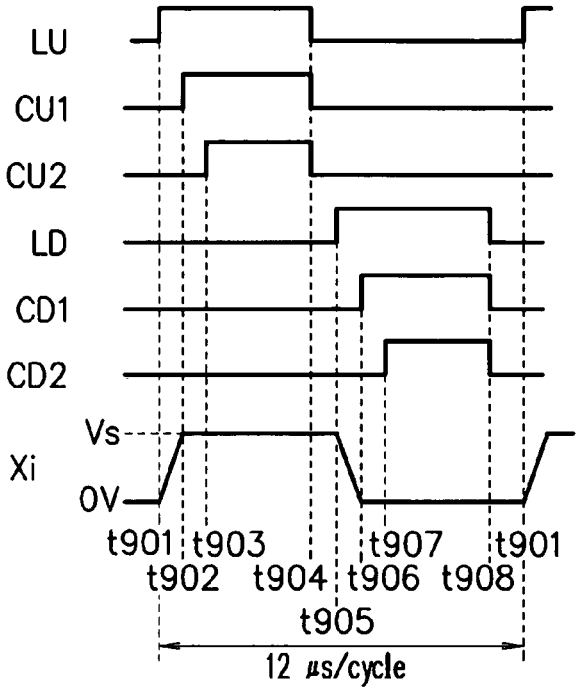
FIG. 9A shows a sustaining pulse generated by the X electrode sustain circuit shown in FIG. 8 in the case of a large display ratio.

FIG. 9A shows a sustaining pulse generated by the X electrode sustain circuit shown in FIG. 8 in the case of a large display ratio.

Before time t901, the transistors LU, CU1, CU2, and LD are off, and transistors CD1 and CD2 are on. At time t901, the transistors CD1 and CD2 are turned off, and the transistor LU is turned on. As explained later, the capacitor 504 stores electric power recovered from the X electrode Xi of the panel capacitance Cp. When the transistor LU is turned on, electric charges of the capacitor 504 are supplied to the X electrode Xi through the transistor LU and the coil 501 by LC resonance. The electric potential of the X electrode Xi rises toward the high level Vs.

Next, at time t902, the transistor CU1 is turned on. Since the transistor CU2 is off, the high level Vs is supplied to the X electrode Xi through a high impedance, and the electric potential of the X electrode Xi is clamped at the high level Vs.

Next, at time t903, the transistor CU2 is turned on. Since the transistor CU1 is also on, the high level Vs is supplied to the X electrode Xi through a low impedance, and the electric potential of the X electrode Xi is clamped at the high level Vs.

Next, at time t904, the transistors LU, CU1 and CU2 are turned off. The electric potential of the X electrode Xi is sustained at the high level Vs.

Next, at time t905, the transistor LD is turned on. The electric charges (electric power) of the X electrode Xi of the panel capacitance Cp are recovered to the capacitor 504 through the coil 501 and the transistor LD by LC resonance. The electric potential of the X electrode Xi falls. In this way, by doing electric power recovery the power consumption can be reduced.

Next, at time t906, the transistor CD1 is turned on. Since the transistor CD2 is off, the ground level is connected to the X electrode Xi through a high impedance, and the X electrode Xi is clamped at 0V.

Next, at time t907, the transistor CD2 is turned on. Since the transistor CD1 is also on, the ground level is connected to the X electrode Xi through a low level, and the X electrode Xi is clamped at 0V.

Next, at time t908, the transistors LD, CD1 and CD2 are turned off. The electric potential of the X electrode Xi is sustained at 0V.

The same process is repeated by taking a period including duration from time t901 to t908 as a cycle. This sustaining pulse is 12 μs/cycle. For example, from time t901 to t902 it is 0.5 μs, from time t902 to t903 is 0.5 μs, from time t903 to t904 is 3 μs, from time t904 to t905 is 1 μs, from time t905 to t906 is 0.5 μs, from time t906 to t907 is 0.5 μs, from time t907 to t908 is 5 μs, and from time t908 to t901 in the next cycle is 1 μs.

At time t902 to t903, since the X electrode Xi is clamped at the high level Vs through a high impedance, weak discharge occurs. After t903, since the X electrode Xi is clamped at the high level Vs through a low impedance, discharge continues to generate. Since this sustaining pulse is the sustaining pulse which distributes the electric power in time, time width of the discharge current becomes broad, and the peak discharge current becomes small. As a result, discharge intensity becomes small, ultraviolet emission intensity and saturation of the fluorescent material becomes small, and then emission efficiency increases. Furthermore, because of the small peak discharge current the streaking can be reduced.

Figure 9B:
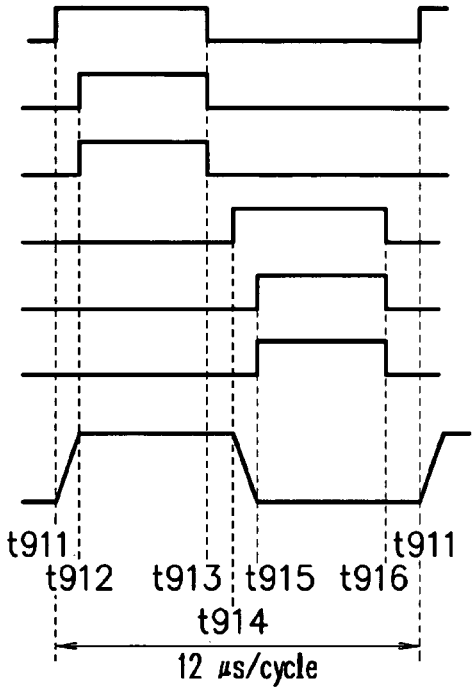
FIG. 9B shows a sustaining pulse generated by the X electrode sustain circuit shown in FIG. 8 in the case of a small display ratio.

FIG. 9B shows a sustaining pulse generated by the X electrode sustain circuit shown in FIG. 8 in the case of a small display ratio.

Prior to time t911, the transistors LU, CU1, CU2, and LD are off, and transistors CD1 and CD2 are on. At time t911, the transistors CD1 and CD2 are turned off, and the transistor LU is turned on. As explained later, the capacitor 504 stores the electric power recovered from the X electrode Xi of the panel capacitance Cp. When the transistor LU is turned on, electric charges of the capacitor 504 are supplied to the X electrode Xi through the transistor LU and the coil 501 by LC resonance. Electric potential of the X electrode Xi rises toward the high level Vs.

Next, at time t912, the transistors CU1 and CU2 are turned on. The high level Vs is supplied to the X electrode Xi through a low impedance, and the electric potential of the X electrode Xi is clamped at the high level Vs.

Next, at time t913, the transistors LU, CU1 and CU2 are turned off. The electric potential of the X electrode Xi is sustained at the high level Vs.

Next, at time t914, the transistor LD is turned on. The electric charges (electric power) of the X electrode Xi of the panel capacitance Cp are recovered to the capacitor 504 through the coil 501 and the transistor LD by LC resonance. The electric potential of the X electrode Xi falls. In this way, by doing electric power recovery the power consumption can be reduced.

Next, at time t915, the transistors CD1 and CD2 are turned on. The ground level is connected to the X electrode Xi, and the X electrode Xi is clamped at 0V.

Next, at time t916, the transistors LD, CD1 and CD2 are turned off. The electric potential of the X electrode Xi is sustained at 0V.

The same process is repeated with a period including duration from time t911 to t916 being a cycle. This sustaining pulse is 12 μs/cycle. For example, from time t911 to t912 it is 0.5 μs, from time t912 to t913 is 3.5 μs, from time t913 to t914 is 1 μs, from time t914 to t915 is 0.5 μs, from time t915 to t916 is 5.5 μs, from time t916 to t911 in the next cycle is 1 μs.

At time t912, since the X electrode Xi is clamped at the high level Vs through a low impedance, strong discharge occurs. Since this sustaining pulse is the sustaining pulse which concentrates the electric power in time, time width of the discharge current becomes narrow, and the peak discharge current becomes large. As a result, peak luminance becomes high.

As explained above, in the present embodiment, in a case with large display ratio, voltage is raised by LC resonance and then voltage clamp to the high level Vs is done by two steps using a high impedance and a low impedance, and in a case with small display ratio, voltage clamp is done by switching the transistors CU1 and CU2 on at the same time. In the case of the two step clamping shown in FIG. 9A, discharge occurs immediately after rise of voltage due to LC resonance, but since the current capability of the transistor CU1 to clamp voltage is small and the impedance is high, discharge current is limited, and therefore voltage drop due to the resistance of the panel electrode is reduced and streaking is improved. Nevertheless, because of limited discharge current, luminance to a single shot of the sustaining pulse is decreased, and peak luminance is also reduced. In a case where the transistors CU1 and CU2 are turned on simultaneously as shown in FIG. 9B, an impedance during discharge is low and large discharge current flows, and therefore luminance is increased. But due to voltage drop in the resistance of the electrode the streaking is large.

In the present embodiment, as shown in FIG. 9A, in the case where display ratio is so large that streaking poses a problem, clamp is made by two steps where rise of the transistor CU1 is separated in time from the rise of the transistor CU2, and in the case where display ratio is so small that streaking does not becomes a severe problem, clamp is made simultaneously by a plurality of transistors CU1 and CU2. Change over of sorts of the sustaining pulse is performed for each sub-frame with the same luminance. In the case where display ratio decreases, all of the sub-frames are changed to the simultaneous clamp, and then increases the number of pulse gradually based upon a decrease of display ratio, thereby high peak luminance is able to be realized. According to the present embodiment, in the case of displaying state where streaking poses a problem, the first sustaining pulse is used which results in reduced streaking and high emission efficiency, and in the case of displaying state where streaking does not becomes a severe problem, the second sustaining pulse which puts priority on luminance is used, thereby resulting in displaying with high peak luminance.

In the present embodiment, multiple step rise was realized by using a plurality of transistors CU1 and CU2, but such rise can be realized also by a way where rise of the transistor (output element) for the voltage clamping is delayed from the voltage rise due to LC resonance. Alternatively, the same effect can be realized by increasing the output resistance of transistors immediately after turning on by increasing the gate resistance of the transistors CU1 and CU2.

Third Embodiment

Figure 10A:
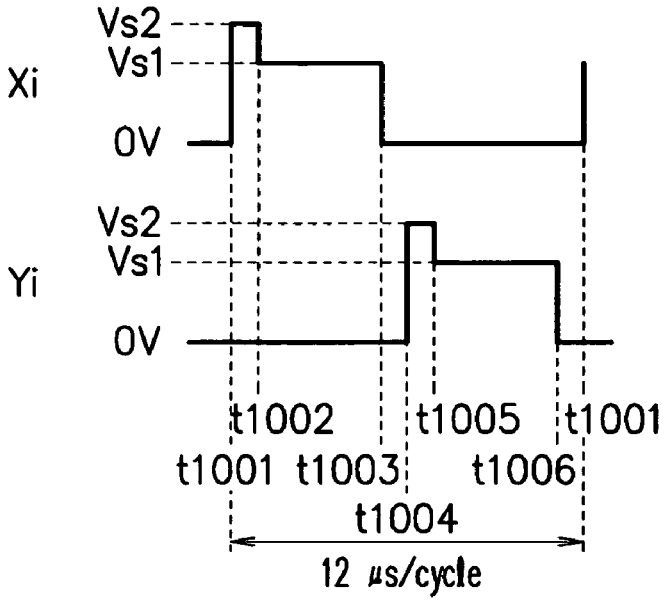
FIG. 10A is a timing chart indicating sustaining pulses on the X electrode and the Y electrode in the case of a large display ratio.
Figure 10B:
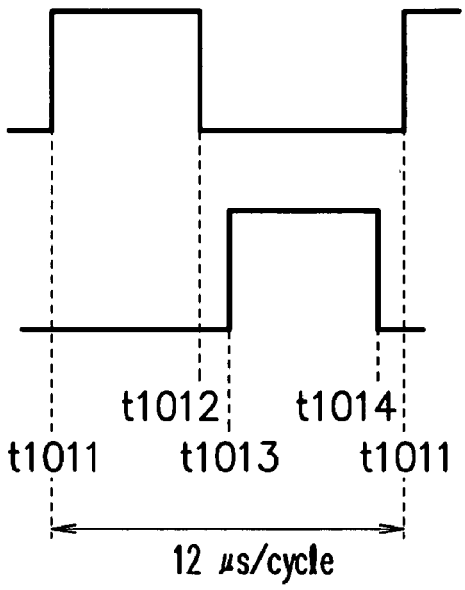
FIG. 10B is a timing chart indicating sustaining pulses on the X electrode and the Y electrode in the case of a small display ratio.

In the third embodiment, in the case of large display ratio a sustaining pulse shown in FIG. 10A is generated, and in the case with small display ratio a sustaining pulse shown in FIG. 10B is generated.

FIG. 10A is a timing chart indicating sustaining pulses on the X electrode Xi and the Y electrode Yi in the case of a large display ratio. FIG. 10B is a timing chart indicating sustaining pulses on the X electrode Xi and the Y electrode Yi in the case of a small display ratio. Under control by the sustaining pulse control section 112, the Y electrode sustain circuit 104 in FIG. 1 generates the sustaining pulse shown in FIG. 10A in the case of a large display ratio, and the sustaining pulse shown in FIG. 10B in the case of a small display ratio. The sustaining pulse shown in FIG. 10A and FIG. 10B is generated during the sustain period Ts shown in FIG. 3.

The sustaining pulses on the X electrode Xi and the Y electrode Yi shown in FIG. 10A take a period including a duration from time t1001 to t1006 as a cycle and pulses are repeated.

First, an explanation is given on the sustaining pulse on the X electrode Xi shown in FIG. 10A. At time t1001 the pulse starts to rise from the 0V low level and clamped at the second high level Vs2 which is higher than the low level. Next at time t1002 it falls from the second high level Vs2 and clamped at the first high level Vs1 which is lower than the second high level. Next, at time t1003 it falls from the first high level Vs1 and clamped at 0V low level. Hereafter it retains the 0V low level up to the end of the cycle.

Next, an explanation is given on the sustaining pulse on the Y electrode Yi shown in FIG. 10A. From time t1001 to immediately prior to time t1004 it sustains at 0V low level. At time t1004 the pulse starts to rise from the 0V low level and clamped at the second high level Vs2 which is higher than the low level. Next at time t1005 it falls from the second high level Vs2 and clamped at the first high level Vs1 which is lower than the second high level. Next, at time t1006 it falls from the first high level Vs1 and clamped at 0V low level. Hereafter it retains the 0V low level up to the end the cycle.

This sustaining pulse is 12 μs/cycle, for example. At time t1001 and t1004, the electric potential difference Vs2 is generated for a short period between the X electrode Xi and the Y electrode Yi, and weak discharge occurs. After t1002 and t1005, the electric potential difference Vs1 is generated between the X electrode Xi and the Y electrode Yi, and discharge continues to generate. Since this sustaining pulse is the sustaining pulse which distributes the electric power in time, time width of the discharge current becomes broad, and the peak discharge current becomes small. As a result, discharge intensity becomes small, ultraviolet emission intensity and saturation of the fluorescent material becomes small, and therefore emission efficiency increases. Furthermore, because of the small peak discharge current the streaking can be reduced.

The sustaining pulses on the X electrode Xi and the Y electrode Yi shown in FIG. 10B take a period including a duration from time t1011 to tl014 as a cycle and pulses are repeated. This sustaining pulse is the same pulse as the sustaining pulse shown in FIG. 4B. Times t1011 to tl014 shown in FIG. 10(B) correspond to times t411 to t414 shown in FIG. 4B, respectively.

This sustaining pulse is 12 μs/cycle, for example. At time t1011 and tl013, electric potential difference Vs2 is generated for a long period between the X electrode Xi and the Y electrode Yi, and strong discharge occurs. Since this sustaining pulse is the sustaining pulse which concentrates the electric power in time, time width of the discharge current becomes narrow, and the peak discharge current becomes large. As a result peak luminance becomes high.

As explained above, according to the present first to third embodiments, in order to realize a plurality of characteristics such as high emission efficiency/reduced streaking and high luminance and the like, more than two sorts of sustaining pulse becomes necessary. Nevertheless since states of discharge/wall charge and the like differ depending on the sort of the sustaining pulse, a display anomaly sometimes happens if change is done within the sustain period Ts. If the reset period Ts and the charge adjustment and sustain period Tc are included, i.e. if the sustaining pulse is changed in unit of sub-frame, however, no problem happens on the operation. Furthermore, a changing in unit of sub-frame makes it relatively easy to settle sustaining pulse individually.

According to the present embodiment, in the case where a display ratio is relatively large where the emission efficiency/streaking poses a problem, display by the first sustaining pulse is used for improving the emission efficiency/streaking, and in the case where a display ratio is relatively small where emission efficiency/streaking does not pose a problem, display by the second sustaining pulse is used for high luminance display. In this occasion, the sustaining pulse is changed sequentially in unit of sub-frame having the reset period Ts and the charge adjustment and sustain period Tc. Since luminance differs depending on the sort of the sustaining pulse even if the pulse number is the same, in a case where a shock of changing the sub-frame is present, a changing is done between the sub-frames with same luminance by changing the number of sustaining pulses, and after all of the sub-frames are changed, sustaining pulse number is gradually increased depending on the display ratio, thereby high peak luminance can be realized.

According to the present embodiment, in the case of a displaying state where the emission efficiency/streaking poses a problem (for example, display ratio of 20% or more), the first sustaining pulse is used, which concentrates the electric power in time as shown in FIG. 6A, FIG. 9A and FIG. 10A and the like. In the case of a displaying state where emission efficiency does not pose a problem due to a small display ratio and streaking does not pose a problem due to a small voltage drop in the display load on each line (for example, display ratio of 15% or less), the second sustaining pulse is used for high luminance display. The second sustaining pulse is the sustaining pulse which distributes the electric power in time as shown in FIG. 6B, FIG. 9B, FIG. 10B, and the like.

Furthermore, to ensure a stable operation and facilitate control, the sorts of the sustaining pulse are changed over for each sub-frame including the reset period Tr and the charge adjustment and sustain period Tc. To reduce the switching shock of luminance, chromaticity and the like accompanied by the change over of the sustaining pulse, the sorts of the sustaining pulse are changed over gradually for each sub-frame by detecting the display ratio. In order to further reduce the switching shock of luminance, there is performed a change over to a sub-frame for sustaining pulses being identical in luminance but different in sort, and thereafter sustaining pulse number is gradually increased depending on the display ratio, thereby high peak luminance can be realized. Thus, one sort of sustaining pulse out of two or more sorts can be selected and outputted depending on the display ratio. As a result, operation becomes stable, control is easy, and the switching shock is not present by change over of the sustaining pulse for sub-frame.

By the way, as in the first to third embodiments the control circuit section 101 having a display ratio detection section 111 and a sustaining pulse control section 112 may be constructed by hardware, or it may be constructed by executing a software based on a computer program by a microcomputer and the like.

Furthermore, in the first to third embodiments the sort of the sustaining pulse was changed by detecting the display ratio. Bt it is not limited to the display ratio, and the sort of the sustaining pulse may be changed by detecting the displaying state of the display pattern or the like where streaking is likely to happen. In this case the detection section 111 detects the displaying state. Furthermore, in place of the sustaining pulse superior for emission efficiency/streaking and the sustaining pulse superior for luminance, for example, a sustaining pulse superior in color purity and gradation characteristics in a displaying state with large display ratio and a sustaining pulse for high luminance with small display ratio may be changed over.

All of the above embodiments merely indicate concreted examples in utilizing this invention. Technological area of the present invention should not be construed so as to be limited thereto. That is, the present invention can be implemented in various forms without deviating from the technological concepts and their main characteristics.

According to the present embodiments, arrangement is made such that there is to be selected and outputted one out of 2 or more sorts of sustaining pulses for a display for each sub-frame depending on the state of display, so that it is made possible to satisfy concurrently the requirements for a plurality of characteristics including high emission efficiency/reduction in streaking and high luminance and the like.

What is claimed is:

1. A display device configured such that one frame forming an image is constituted by a plurality of sub-frames, comprising:

a detection section detecting a display ratio of the one frame forming an image;

a sustaining pulse control section selecting and outputting one out of 2 or more sorts of sustaining pulses whose peak luminance and light emission efficiency are different for each sub-frame depending on the display ratio, wherein, the sustaining pulse control section outputs a frame having all sub-frames composed of a first sustaining pulse that is able to increase the light emission efficiency in the 2 or more sorts of sustaining pulses upon the display ratio being larger than a first threshold value, the sustaining pulse control section controls to be contained a sub-frame composed of a second sustaining pulse that is able to heighten the peak luminance and a sub-frame composed of the first sustaining pulse in a frame upon the display ratio being smaller than the first threshold value, and the sustaining pulse control section controls a change to select sustaining pulses from the first sustaining pulse to the second sustain pulse to start in order from a sub-frame having a lowest luminance upon the display ratio being changed gradually from larger than the first threshold value to smaller than the first threshold value.

2. The display device according to claim 1, wherein the first sustaining pulse allowing an electric power to be distributed in terms of time and the second sustaining pulse allowing an electric power to be concentrated in terms of time.

3. The display device according to claim 2, upon the display ratio being smaller than a second threshold value, all sub-frames in a frame are composed of a second sort of sustaining pulses.

4. The display device according to claim 3, upon the display ratio being smaller than the second threshold value, the number of the sustaining pulses in a sub-frame is changed based upon the display ratio.

5. The display device according to claim 4, upon the display ratio being smaller than the second threshold value and larger than a third threshold value, the number of the sustaining pulse in a sub-frame is increased as the display ratio becomes smaller.

6. The display device according to claim 5, upon the display ratio being smaller than the third threshold value, all sub-frames in a frame are composed of the second sort of sustaining pulses and the number of the sustaining pulses has a constant value.

7. The display device according to claim 6, upon the display ratio being smaller than the first threshold value and larger than the second threshold value, a ratio of the number of sub-frames being composed of a first sort of sustaining pulse to the number of sub-frames being composed of the second sort of sustaining pulse in a frame is changed based upon the display ratio.

8. The display device according to claim 7, wherein a ratio of the number of sub-frames being composed of the second sort of sustaining pulse is increased as the display ratio becomes smaller.

9. The display device according to claim 8, wherein a group of sub-frames being composed of the first sustaining pulse contains a sub-frame with almost the same luminance as a sub-frame in a group of sub-frames being composed of the second sustaining pulse and wherein when a sub-frame being composed of the first sustaining pulse and a sub-frame being composed of the second sustaining pulse are mixed in a frame, the frame is constituted by any of sub-frames with almost the same luminance in the groups of sub-frames being composed of the first and the second sustaining pulse.

10. The display device according to claim 9, wherein the sub-frames with almost the same luminance are different in the number of pulse.

11. The display device according to claim 8, wherein the first threshold value of the display ratio is 25% or less, the third threshold value of the display ratio is 5% or more, the second threshold value is less than the first threshold value, and the third threshold value is less than the second threshold value.

12. The display device according to claim 1, wherein the first sustaining sort of pulse rises from the low level and is clamped at the first high level, and thereafter rises from the first high level and is clamped at the second high level.

13. The display device according to claim 1, wherein a first sort of sustaining pulse rises from the low level and is clamped at the second high level, and thereafter falls from the second high level and is clamped at the first high level.

14. The display device according to claim 1, wherein a first sort of sustaining pulse rises from the low level and is clamped at the high level by a high impedance, and then is clamped at the high level by a low impedance.

15. The display device according to claim 1, wherein the detection section detects the display ratio based on the current flowing by one of the sustaining pulse, power consumption and image data.

16. A display method for a display of images of which one frame forming an image is constituted by a plurality of sub-frames, comprising:

detecting a display ratio of the one frame forming an image;

a sustaining pulse controlling of selecting and outputting one out of 2 or more sorts of sustaining pulse whose peak luminance and light emission efficiency are different for each sub-frame depending on the display ratio, wherein:

the sustaining pulse controlling an outputting a frame having all sub-frames composed of a first sustaining pulse that is able to increase the light emission efficiency in the 2 or more sorts of sustaining pulses upon the display ratio is larger than a first threshold value, the sustaining pulse controlling contains a sub-frame composed of a second sustaining pulse that is able to heighten the peak luminance and sub-frame composed of the first sustaining pulse in a frame upon the display ratio being smaller than the first threshold value, and the sustaining pulse controlling changes to select sustaining pulses from the first sustaining pulse to the second sustain pulse to start in order from the sub-frame which is the lowest luminance upon the display ration being changed gradually from larger than the first threshold value to smaller than the first threshold value.

17. A method to reduce displayed image streaking, comprising:

selecting and outputting one of a plurality of sorts of sustaining pulses whose peak luminance and light emission efficiency are different for each sub-frame depending on a display ratio.

* * * * *

UNITED STATES PATENT AND TRADEMARK OFFICE

CERTIFICATE OF CORRECTION

PATENT NO. : 7,663,574 B2
APPLICATION NO. : 11/269711
DATED : February 16, 2010
INVENTOR(S) : Akira Ootsuka et al.

It is certified that error appears in the above-identified patent and that said Letters Patent is hereby corrected as shown below:

Column 18, Line 45, change "ration" to --ratio--.

Signed and Sealed this

Fifteenth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,663,574 B2
APPLICATION NO. : 11/269711
DATED : February 16, 2010
INVENTOR(S) : Otsuka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1014 days.

Signed and Sealed this

Thirtieth Day of November, 2010

David J. Kappos

David J. Kappos
*Director of the United States Patent and Trademark Office*